US005735701A

United States Patent [19]

Jarrett

[11] Patent Number: 5,735,701

[45] Date of Patent: Apr. 7, 1998

[54] LOCKING POWER CABLE INTERFACE GUARD

[75] Inventor: Brian S. Jarrett, Cornelius, Oreg.

[73] Assignee: Intel Corporation, Santa Clara, Calif.

[21] Appl. No.: 570,239

[22] Filed: Dec. 11, 1995

[51] Int. Cl.[6] ..... H01R 13/44

[52] U.S. Cl. ..... 439/147; 439/299; 439/924.2

[58] Field of Search ..... 439/924.2, 136, 439/144, 147, 347, 373, 299

[56] References Cited

U.S. PATENT DOCUMENTS 1,947,634 2/1934 Anderson ..... 439/373

2,399,644 5/1946 Lachance ..... 439/373

5,224,868 7/1993 Tseng ..... 439/136

*Primary Examiner*—Khiem Nguyen

*Assistant Examiner*—Eugene G. Byrd

*Attorney, Agent, or Firm*—Charles Young

[57] ABSTRACT

A power supply includes a power cable interface. The power supply also includes an interface guard. The interface guard has an unlocked position and a locked position. When the interface guard is in the unlocked position, the power supply can be attached and detached from a chassis of an electrical system. When the interface guard is in the locked position, the power supply cannot be attached or detached from the chassis of the electrical system. The power cord can only be attached to the power supply while the interface guard is in the locked position.

18 Claims, 3 Drawing Sheets

LOCKING POWER CABLE INTERFACE GUARD

FIELD OF THE INVENTION

The present invention relates to the field of power supplies; more particularly, the present invention relates to coupling a power supply to and decoupling a power supply from an electrical system.

BACKGROUND OF THE INVENTION

Electrical systems require a power supply. Some electrical systems use more than one power supply in order to provide redundant power in case one of the power supplies fails. Some electrical systems with redundant power supplies have interfaces which allow the power supplies to be inserted into and removed from the electrical system while the electrical system remains in a power-up state. For example, a computer system, such as a computer server, may be required to operate continuously. The ability to swap a new power supply in for one that has failed, while the computer server remains in a power-up state, is crucial.

If the electrical system and the power supply are both in a power-up state during coupling and decoupling of the power supply to the electrical system, there is a possibility of arcing and power surge between the power supply and the electrical system, as is well-known in this field. This can result in flammable debris spilling from the power supply. Additionally, arcing and power surge can damage both the power supply and the electrical system. One way of lowering the possibility of damage due to arcing and power surge is by adding protective circuitry to the power supply and the electrical system.

Another way to reduce the possibility of damage due to arcing is by manually ensuring that the power supply is powered off before coupling the power supply to the electrical system and before decoupling the power supply from the electrical system. However, due to the possibility of human error, this solution lacks a degree of safety. A safe and relatively inexpensive means of ensuring that the power supply is powered down before installing or removing the power supply from an electrical system is desired.

SUMMARY OF THE INVENTION

A power supply housing includes a power cable interface. The power supply housing also includes an interface guard. The interface guard has an unlocked position which blocks the power cable interface. The interface guard also has a locked position which does not block the power cable interface.

BRIEF DESCRIPTION OF THE DRAWINGS

The present invention will be understood more fully from the detailed description given below and from the accompanying drawings of the preferred embodiments of the invention, which, however, should not be taken to limit the invention to the specific embodiments, but are for explanation and understanding only.

DETAILED DESCRIPTION OF THE PRESENT INVENTION

A method and apparatus for coupling a power supply to and decoupling a power supply from an electrical system is described. In the following detailed description of the present invention numerous specific details are set forth in order to provide a thorough understanding of the present invention. However, it will be obvious to one skilled in the art that the present invention may be practiced without these specific details.

Figure 1:
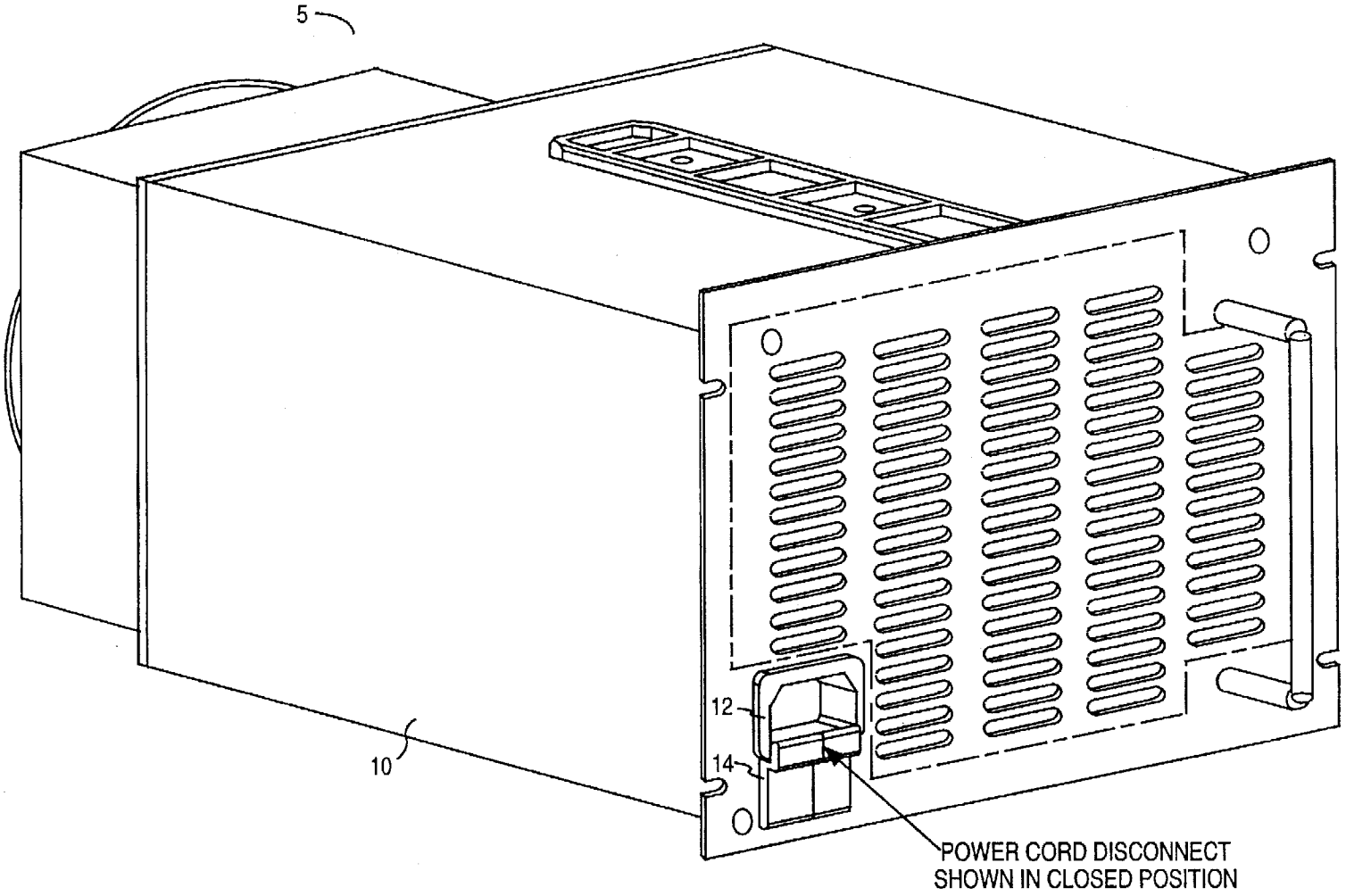
FIG. 1 is a drawing of a power supply showing one embodiment of the interface guard of the present invention.

FIG. 1 is a drawing of a power supply 5 showing one embodiment of the interface guard 14 of the present invention. The power supply housing 10 of the power supply includes the casing, connectors, and extremities of the power supply. The housing 10 encases an electrical transformer, regulator, or other devices which are well-known in the art and are not particularly relevant to the present invention. A power cable interface 12 allows for a power cable 20 (shown in FIG. 2) to be coupled to the power supply 5. The power cable 20 provides power from an electrical outlet to the power supply 5 putting the power supply 5 into a power-up state. When the power supply 5 is in its power up state, it is capable of providing power to other electrical devices or systems.

The power supply housing 10 includes an interface guard 14. The interface guard 14 has a locked position and an unlocked position. When the interface guard 14 is in the unlocked position, it blocks the power cable interface 12. This prevents the power cable 20 from being coupled to the power cable interface 12 while the interface guard remains in its unlocked position. Thus, since coupling to the power cable 20 is required for the power supply 5 to be in a power up state, the interface guard 14 prevents the power supply 5 from being in a power up state while the interface remains in its unlocked position.

Figure 2:
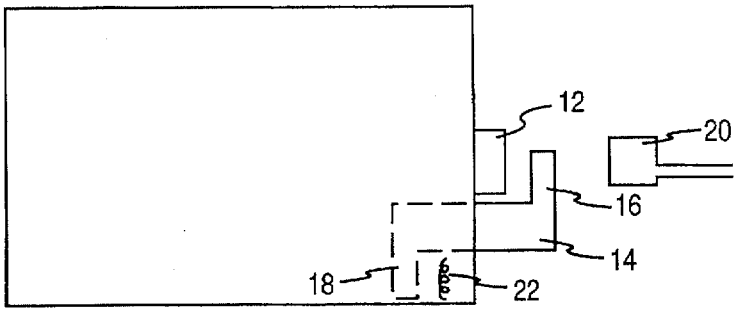
FIG. 2 is diagram showing a cutaway side view of one embodiment of the interface guard when the interface guard is in an unlocked position.

FIG. 2 is diagram showing a cutaway side view of one embodiment of the interface guard 14 when the interface guard is in its unlocked position. In one embodiment, the interface guard 14, is a single piece of plastic which extends into the interior of the power supply housing 10. The interface guard 14 has a first flange 16 and a second flange 18. When the interface guard 14 is in its unlocked position, the first flange 16 prevents a power cable 20 from being coupled to the power cable interface 12. When the interface guard is in the unlocked position, the second flange 18 remains within the power supply housing 10.

In one embodiment, the interface guard 14 is made of a single piece of plastic. In one embodiment, a spring 22 keeps the interface guard in the unlocked position, unless the interface guard is manually moved to its locked position.

Figure 3:
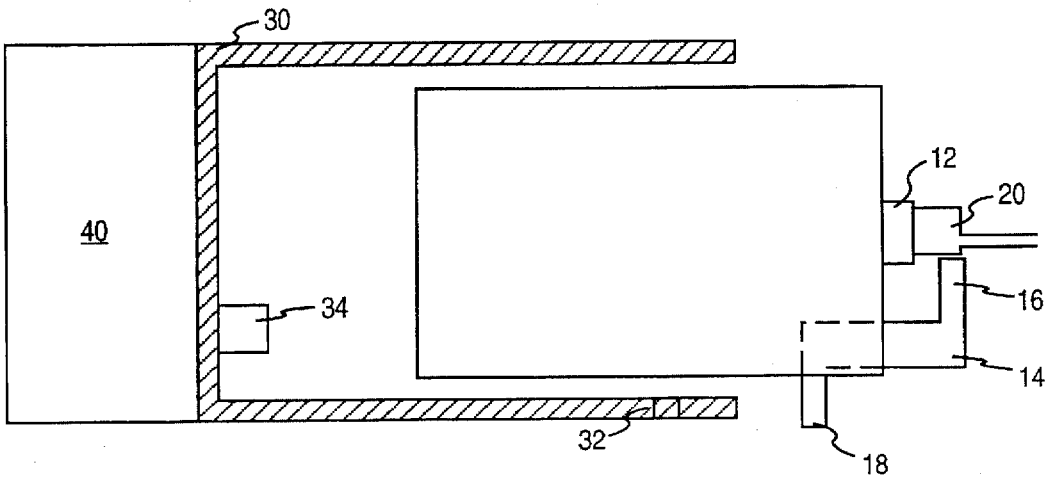
FIG. 3 is diagram showing a cutaway side view of one embodiment of the interface guard when the interface guard is in a locked position prior to installation of the power supply into a chassis.

FIG. 3 is diagram showing a cutaway side view of one embodiment of the interface guard when the interface guard is in its locked position prior to installation of the power supply into a chassis. The interface guard is manually put in the locked position, then the power cable 20 is coupled to the power cable interface 12. The power cable 20 makes contact with the first flange 16 of the interface guard 14 which prevents the interface guard from returning to the unlocked position while the power cable 20 remains coupled to the power cable interface 12.

When the interface guard 14 is in its locked position, the second flange 18 is extended out of the power supply housing 10 through an opening in the housing. The flange 18 prevents the installation of the power supply into a chassis 30, wherein the chassis 30 is a part of an electrical system 40 such as a computer system or computer server.

Figure 4:
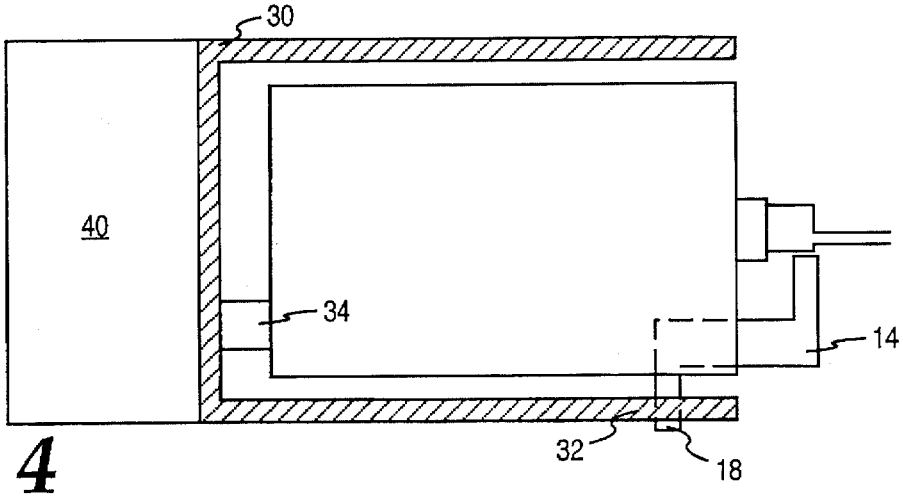
FIG. 4 is diagram showing a cutaway side view of one embodiment of the interface guard when the interface guard is in a locked position after installation of the power supply into a chassis.

However, if the power supply is installed into the chassis 30 while the interface guard is in its unlocked position, and the power cable is coupled to the power cable interface after the power supply is in the chassis 30, then the second flange 18 of the interface guard provides a locking mechanism by extending out of the power supply housing 10 into a slot 32 in the chassis 30 of the electrical system 40, as shown by FIG. 4.

FIG. 4 is diagram showing a cutaway side view of one embodiment of the interface guard when the interface guard 14 is in its locked position after installation of the power supply into the chassis 30. While the interface guard 14 remains in its locked position, the power supply 5 remains locked into place within the chassis 30. The chassis 30 includes an interface 34 which couples to the power supply 5 for providing power from the power supply 5 to the electrical system 40.

The electrical system 40 may be coupled to multiple chassis each having a power supply 5 in order to provide redundant power to the electrical system 40 in case one of the power supplies fails. The electrical system 40 remains powered up during the installation of the power supply 5 to the electrical system 40 via the interface 34. The interface guard 14 prevents the power supply from being coupled to the interface 34 while the power supply 5 is coupled to the power cable 20. Thus, the interface guard 14 prevents the power supply from being coupled to the interface 34 while the power supply 5 is powered up, which reduces the possibility of arcing and power surge between the power supply and the electrical system 40 and the interface 34

Additionally, the interface guard 14 prevents the power supply 5 from being decoupled from the interface 34 while the power supply is powered up because the flange 18 of the interface guard prevents the power supply 5 from being removed from the chassis 30 while the power cable 20 is attached to the power supply. This also reduces the possibility of arcing and power surge between the power supply and the electrical system 40 and the interface 34.

Thus, the power supply 5 can be coupled to and decoupled from the electrical system 40 when the interface guard 14 of the power supply is in its unlocked position, but the power supply cannot be coupled to or decoupled from the electrical system when the interface guard is in its locked position. The power cable 20 can only be attached to the power supply 5 when the interface guard 14 is in the locked position.

Figure 5:
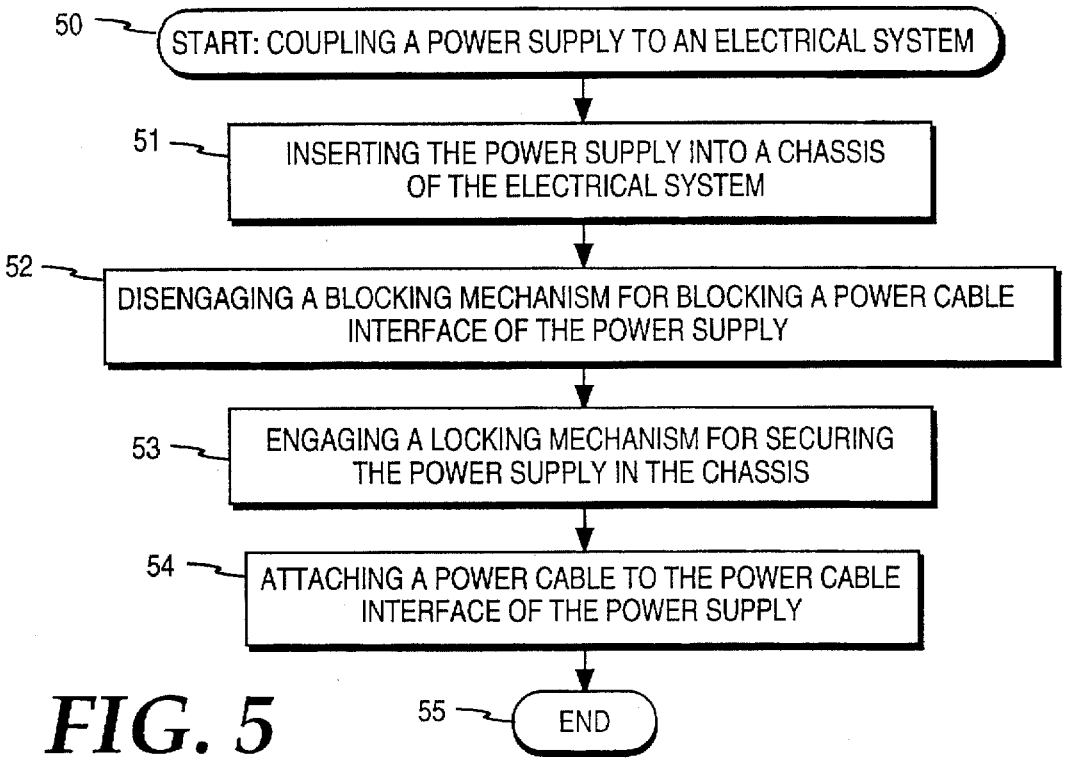
FIG. 5 is a flow diagram showing the steps taken in using the interface guard to couple a power supply to an electrical system.

FIG. 5 is a flow diagram showing the steps taken in using the interface guard to couple a power supply to the electrical system 40. The flow diagram of FIG. 5 begins at a block 50 and proceeds at a block 51. At block 51, the power supply 5 is inserted into a chassis of the electrical system 40. The power supply 5 couples to the interface 34 of the electrical system 40. From block 51, the flow diagram proceeds at a block 52, at which a blocking mechanism for blocking the power cable interface 12 to the power supply 5 is disengaged. The flow diagram proceeds at block 53, at which a locking mechanism for securing the power supply in the chassis 30 is engaged. In one embodiment, the second flange 18 is used to secure the power supply in the chassis 30. From the block 53, the flow diagram proceeds at block 54, at which a power cable 20 is attached to the power cable interface 12 of the power supply by manually moving the interface guard 14 to its locked position. In one embodiment, moving the interface guard 14 to its locked position automatically results in the disengaging of the blocking mechanism of block 52 and the engaging of the locking mechanism of block 53. In another embodiment, these three steps may be performed separately, and/or they may be performed manually. The flow diagram proceeds at block 55, at which the flow diagram terminates.

Figure 6:
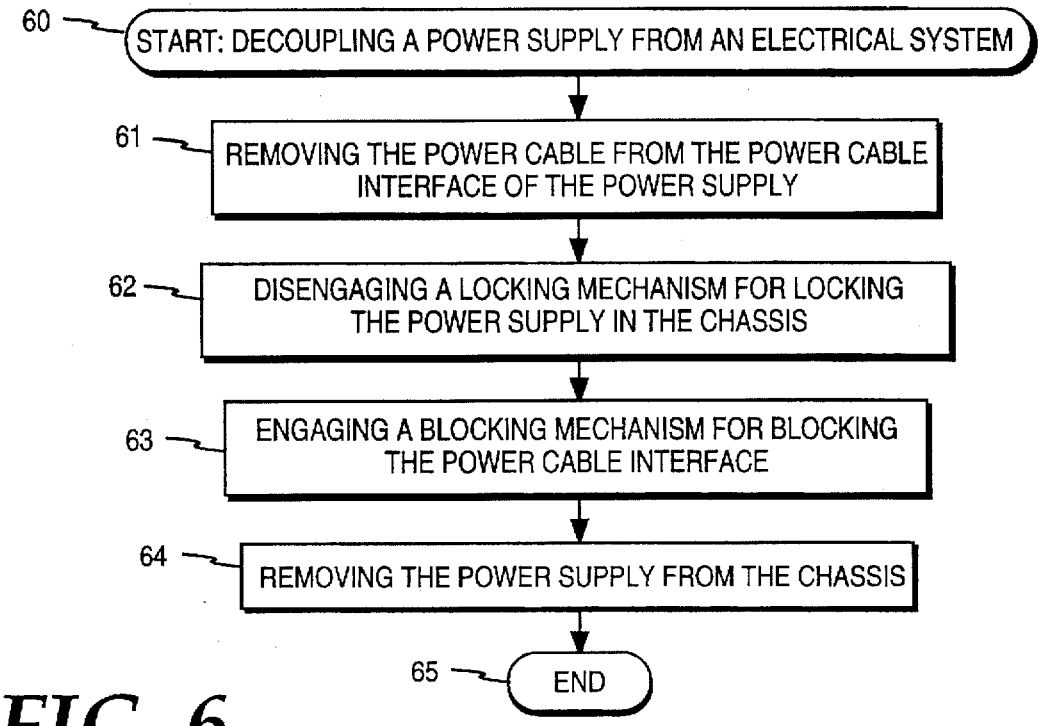
FIG. 6 is a flow diagram showing the steps taken in using the interface guard to decouple a power supply from an electrical system.

FIG. 6 is a flow diagram showing the steps taken in using the interface guard to decouple a power supply from the electrical system 40. The flow diagram of FIG. 6 begins at a block 60 and proceeds at a block 61. At block 61, the power cable 20 is removed from the power cable interface 12 of the power supply 5. From block 61, the flow diagram proceeds at a block 62, at which a locking mechanism for locking the power supply in the chassis is disengaged. The flow diagram proceeds at block 63, at which a blocking mechanism for blocking the power cable interface 12 is engaged. In one embodiment, the power cable interface is blocked with a flange of the interface guard 14. In another embodiment, an arm or lever may be used to perform the blocking of the power cable interface. In one embodiment, removing the power cable in flow block 61 automatically results in disengaging the locking mechanism of block 62 and engaging the blocking mechanism of block 63. In another embodiment, these three steps may be performed separately, and/or they may be performed manually. From the block 63, the flow diagram proceeds at block 64, at which the power supply is removed from the chassis 30. The flow diagram proceeds at block 65, at which the flow diagram terminates.

Thus, an apparatus and method for coupling a power supply to and decoupling a power supply from an electrical system is disclosed. The specific arrangements and methods described herein are merely illustrative of the principles of this invention. Numerous modifications in form and detail may be made without departing from the scope of the described invention. Although this invention has been shown in relation to a particular embodiment, it should not be considered so limited. Rather, the described invention is limited only by the scope of the appended claims.

What is claimed is:

1. A power supply housing comprising:

a power cable interface, the power cable interface for coupling a power cable to the power supply housing; and an interface guard, the interface guard having an unlocked position and a locked position, the interface guard blocking the coupling of the power cable to the power cable interface when in the unlocked position, and the interface guard not blocking the coupling of the power cable to the power cable interface in the locked position.

2. The power supply housing of claim 1 wherein the interface guard is in the unlocked position when the power cable is coupled to the power cable interface, and the interface guard is in the locked position when the power cable is not coupled to the power cable interface.

3. The power supply housing of claim 1 wherein an arm is extended from the power supply housing when the interface guard is in the locked position, and the arm is not extended from the power supply housing when the interface guard is in the unlocked position.

4. The power supply housing of claim 3 wherein the arm extends out of the power supply housing to prevent installation of the power supply housing into a chassis when the interface guard is in the locked position and the power supply housing is not yet installed in the chassis.

5. The power supply housing of claim 3 wherein the arm extends out of the power supply housing to engage into a slot of a chassis when the interface guard is in the locked position and the power supply housing is already installed in the chassis.

6. A power supply housing comprising:

a power cable interface, the power cable interface for coupling a power cable to the power supply housing; and an interface guard, the interface guard having an unlocked position wherein the interface guard blocks the power cable interface, and the interface guard having a locked position wherein the interface guard does not block the power cable interface, the interface guard taking the unlocked position when the power cable is not coupled to the power cable interface, the interface guard taking the locked position when the power cable is coupled to the power cable interface.

7. The power supply housing of claim 6 wherein the interface guard blocks the power cable interface with a flange of the interface guard when in the unlocked position.

8. The power supply housing of claim 6 wherein a flange of the interface guard is extended from the power supply housing when the interface guard is in the locked position.

9. The power supply housing of claim 6 wherein the interface guard is coupled to a spring which keeps the interface guard in the unlocked position when the power cable is not attached to the power cable interface.

10. A power supply comprising:

a blocking means for preventing the power supply from being installed into an electrical system while a power cable is attached to the power supply.

11. The power supply of claim 10 further comprising:

a securing means for locking the power supply to a chassis while the power cable is attached to the power supply.

12. The power supply of claim 11 wherein the blocking means and the securing means are a common unit.

13. A power supply comprising:

a power cable interface; and an interface means having a locked position and an unlocked position, the interface means for preventing the power supply from attaching to and detaching from a chassis of an electrical system when the interface means is in the locked position, the interface means for allowing the power supply to attach to and detach from the chassis of the electrical system when the interface means is in the unlocked position, and the interface means for preventing coupling of a power cable to the power cable interface when the interface means is in the unlocked position.

14. An electrical system comprising:

a power supply chassis; and a power supply for coupling to the power supply chassis, the power supply having an interface means, the interface means having a locked position and an unlocked position, the interface means for preventing attachment and detachment of the power supply and the power supply chassis when the interface means is in the locked position, the interface means for allowing attachment and detachment of the power supply and the power supply chassis when the interface means is in the unlocked position, and the interface means for preventing coupling of a power cable to the power supply when the interface means is in the unlocked position.

15. An electrical system comprising:

a power supply chassis;

a power supply for coupling to the power supply chassis, the power supply having an interface guard with a locked position and an unlocked position, the interface guard preventing attachment and detachment of the power supply and the power supply chassis when the interface guard is in the locked position, the interface guard for allowing attachment and detachment of the power supply and the power supply chassis when the interface guard is in the unlocked position, the interface guard automatically changing to the locked position responsive to a power cable being coupled to the power supply, and the interface guard automatically changing to the unlocked position responsive to the power cable being decoupled from the power supply.

16. The electrical system of claim 15 wherein the electrical system is a computer system.

17. A device comprising:

a power cable interface, the power cable interface for coupling a power cable to the device; and an interface guard, the interface guard having an unlocked position and a locked position, the interface guard blocking attachment of the power cable to the power cable interface when in the unlocked position, and the interface guard not blocking attachment of the power cable to the power cable interface in the locked position.

18. The device of claim 17 wherein the device is a power supply for a computer system.

* * * * *